367-93 $$$ SR
E245K YR 4,117

United States Patent [19]

Miller

[11] 4,117,462

[45] Sep. 26, 1978

[54] ULTRASONIC TRANSMITTER FOR BURGLAR ALARM SYSTEM

[75] Inventor: Albert J. Miller, Santa Clara, Calif.

[73] Assignee: Engineering Systems Corporation, Santa Clara, Calif.

[21] Appl. No.: 691,790

[22] Filed: Jun. 1, 1976

[51] Int. Cl.[2] ..... G08B 13/08

[52] U.S. Cl. ..... 340/539; 340/558; 340/310 R

[58] Field of Search ..... 340/58, 63, 64, 65, 340/213 R, 216, 224, 274 R, 276, 310 R, 310 A, 388, 396, 409, 416, 258; 325/185

[56] References Cited

U.S. PATENT DOCUMENTS

| | | | |
|---|---|---|---|
| 2,905,762 | 9/1959 | Rettie et al. | 340/416 |
| 3,112,486 | 11/1963 | Adler | 343/225 |

FOREIGN PATENT DOCUMENTS

| | | | |
|---|---|---|---|
| 2,437,341 | 2/1976 | Fed. Rep. of Germany | 340/416 |
| 1,361,499 | 7/1974 | United Kingdom | 340/224 |

*Primary Examiner*—Alvin H. Waring
*Attorney, Agent, or Firm*—Harris Zimmerman

[57] ABSTRACT

An ultrasonic transmitter for apprising a central burglar alarm system of an unauthorized event includes a transmitting diaphragm which is repeatedly struck by a metal ball driven by a lever. The lever is actuated by a toothed wheel which is rotated by a motor spring, the rotation being governed to maintain constant speed and constant ultrasonic pulse rate. The rotation of the wheel is stopped by a striker interfering therewith, the striker being spring biased to the non-interference position. Thus the striker must be retained in the interference position by a door, window, trip wire, or the like, and any disruption of these structures will trip the striker and cause the transmitter to generate an ultrasonic pulse train and sound an alarm.

23 Claims, 8 Drawing Figures

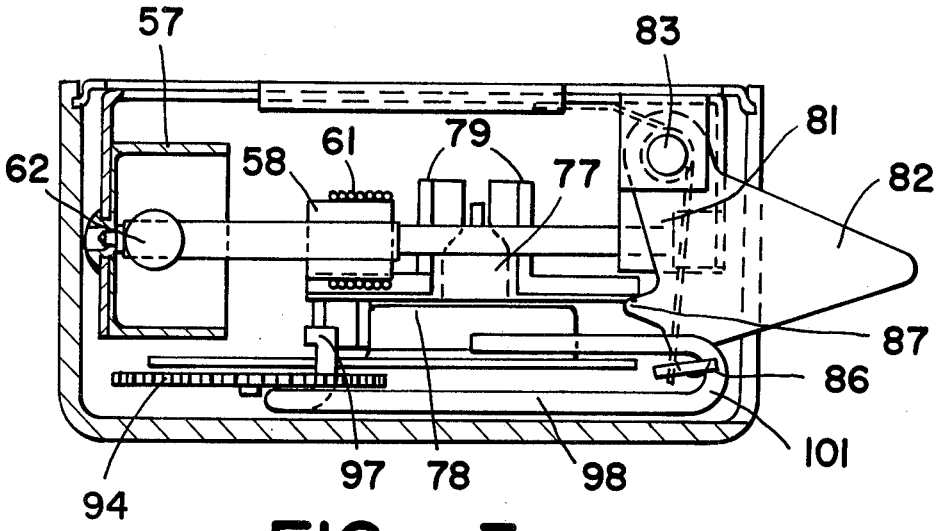
FIG _ 3
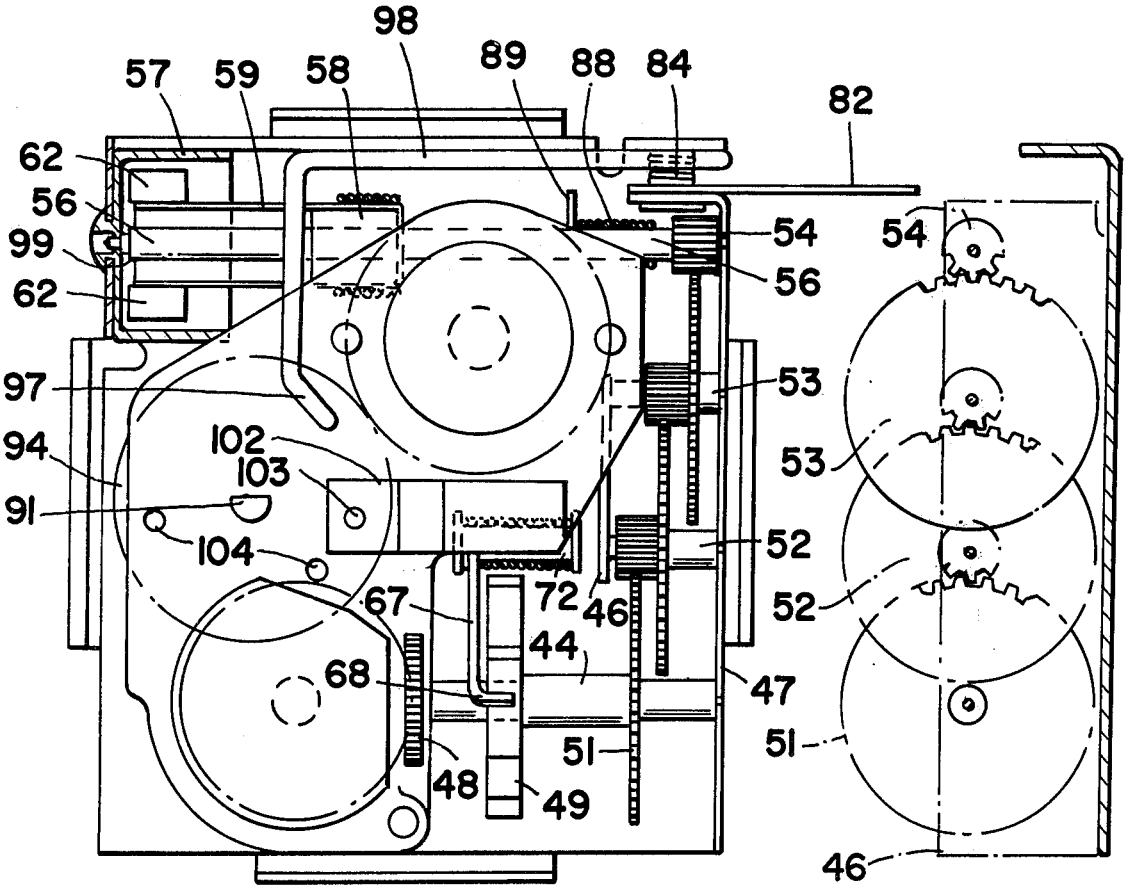
FIG _ 2
FIG _ 4

ULTRASONIC TRANSMITTER FOR BURGLAR ALARM SYSTEM

BACKGROUND OF THE INVENTION

It is well known that there has been a dramatic increase in recent years in the number of crimes against property committed annually. This wave of crime has tempered the joy of ownership and use with anxiety over the depredations of thieves, robbers, and burglars. Furthermore, many individuals in the apparent safety of their own homes do not feel secure from attacks on their person. For these and other reasons, many people have turned to some form of burglar alarm protection for their homes and property.

A common form of burglar alarm is a system in which a plurality of trip switches are disposed at doors and windows through which forced entry is likely. The switches are wired to a central monitor, and the cost and labor involved in the wiring are a major expense of such a system.

To reduce the amount of wiring required, these systems have been improved by the use of trip switches which plug into electrical wall outlets and send a trip signal through the house wiring to a central monitor. These systems still require wiring from the trip switch to the wall outlet and, not surprisingly, occupy a large number of the available outlets in a home.

Recently much interest and developmental work has focussed on ultrasonic alarms which flood a room (or many rooms) with ultrasonic sound, and use doppler shift to detect motion within the sound field. These systems are generally unsuitable for use in homes, since the rooms of a house are used by the owner and family randomly and casually. Too frequently a homeowner sets off the burglar alarm in his own home through sheer carelessness, merely by opening the door of a protected room.

SUMMARY OF THE INVENTION

The present invention generally provides a trip switch type of burglar alarm in which no wiring is required, few electrical outlets are used, and the opportunities for false alarms are minimized. Furthermore, no degradable energy sources such as batteries are used, so that the readiness of any trip switch is always assured.

Each trip switch includes a striker for sensing a forced entry or an unauthorized intrusion, and an ultrasonic sender which emits a burst of ultrasonic pulses. At least one transceiver is disposed within the protected area to receive the ultrasonic signals and transmit an RF signal through the building wiring to a central monitor. The central monitor then emits an alarm or notifies the police through telephone lines.

The unique ultrasonic sender of the present invention includes a diaphragm which vibrates at a frequency above the human hearing range, and a ball which is driven into the diaphragm by a lever. The lever in turn is driven by a rotating toothed wheel which repeatedly strikes one end of the lever, thereby causing multiple impacts of the ball and a series of ultrasonic pulses. The toothed wheel is rotated by a spiral wound motor spring acting through a series of pinion gears. A centrifugal governor mechanism is provided to regulate the rotation rate of the toothed wheel, so that the ultrasonic bursts will occur at a uniform rate. The teeth of the wheel may be spaced in a non-uniform manner to generate a coded signal burst.

The striker acts to immobilize the governor mechanism, but it is spring biased out of engagement with the governor. Thus a door, window, or trip wire must serve to impinge on the striker and maintain the immobilizing engagement. Any relative motion between the striker and the door or window will free the striker and allow the transmitter to emit an ultrasonic tone burst.

The device may be set by a knob, which also serves to wind the spring if it should be discharged. Alternatively, an A/D shaft is provided to operate in conjunction with a lock mechanism to permit arming of the device from outside the protected area. Thus no time delay mechanisms are required to permit the owner sufficient time to exit from the building.

THE DRAWING

FIG. 2 is a plan view of the ultrasonic transmitter of the present invention.

FIG. 3 is a top cross-sectional view of the ultrasonic transmitter of the present invention.

FIG. 4 is a cross-sectional side view of the ultrasonic transmitter of the present invention.

DESCRIPTION OF THE PREFERRED EMBODIMENT

Figure 1:
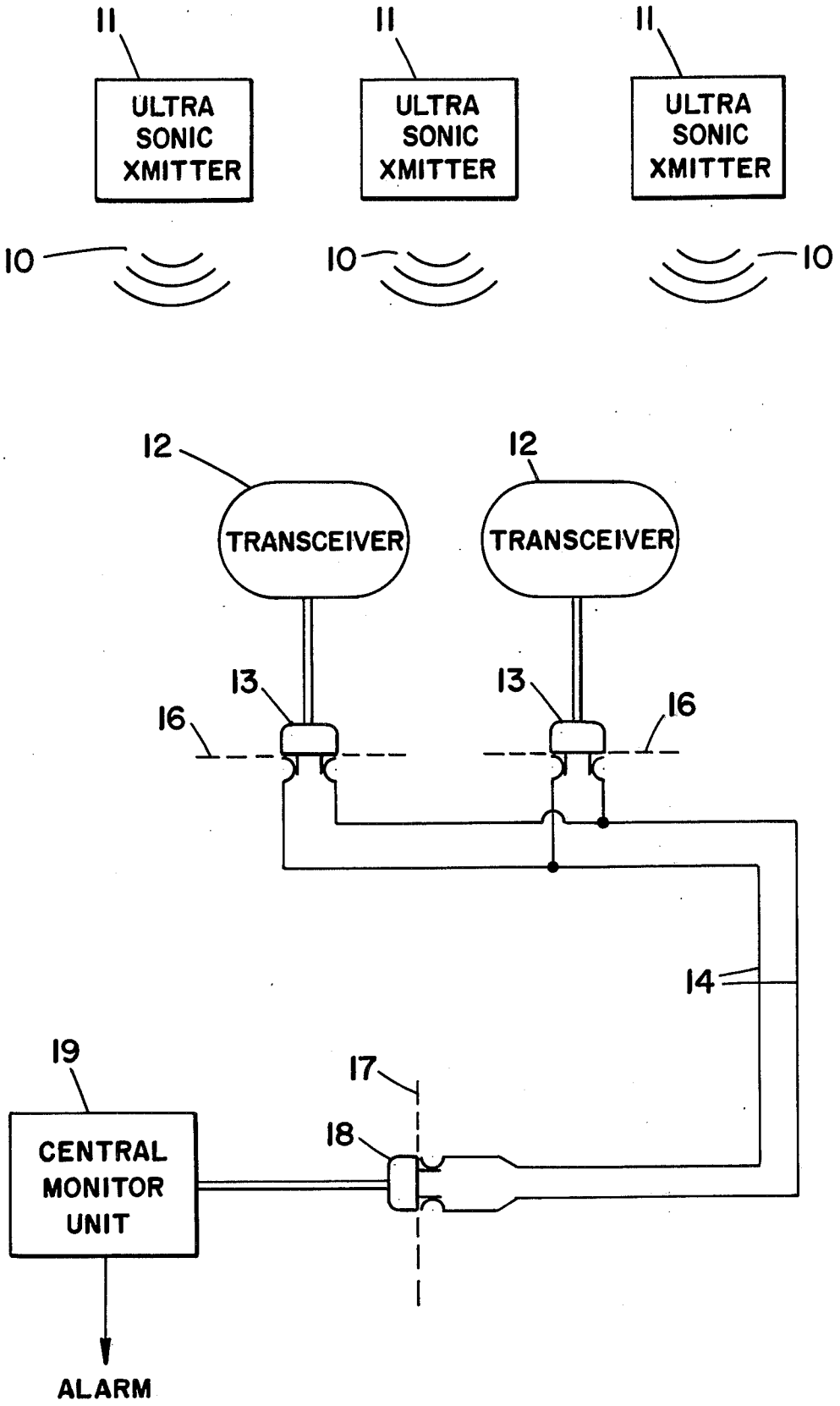
FIG. 1 is a block diagram of the burglar alarm system of the present invention.

The burglar alarm system of the present invention, as shown in FIG. 1, generally comprises a plurality of ultrasonic transmitters 11 which are designed to emit a burst 10 of ultrasonic pulses upon sensing intrusion or unauthorized activity. Each transmitter is disposed at a door or window for which protection is desired, or a transmitter may be coupled to a trip wire to sense movement through a particular area. The transmitters have a self-contained power source.

The sound bursts 10 are received by one of a plurality of transceivers 12, which in turn are actuated by the sound burst to emit a radio frequency signal. The transceivers are advantageously deployed one to a protected room, though more than one may be required for large rooms or areas. Each transceiver includes a plug 13, which is received in a normal electrical wall outlet 16, for powering the transceiver. The plug 13 also acts as a conductor for the radio frequency signal to feed the signal into the building electrical wiring 14.

A central monitor unit 19 is also provided, disposed in a safe area of the building and connected to the building wiring through a plug 18 and a wall receptacle 17. The central monitor unit receives any radio frequency signals sent through the building wiring from any of the transceivers, and in response emits an alarm signal. The alarm signal may be a loud bell or siren, or may include an automatic telephone notification to the police. Such central monitor units and transceivers are known in the art, and are not described in detail herein.

Figure 8:
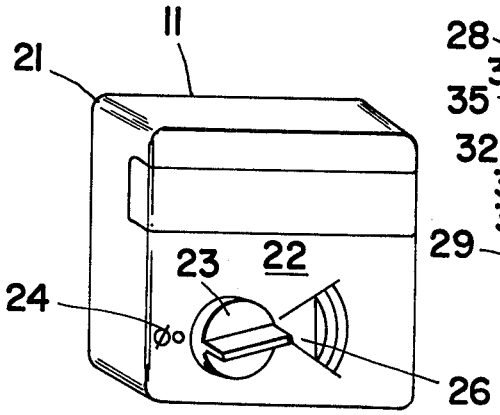
FIG. 8 is a perspective view of the ultrasonic transmitter of the present invention.

A salient aspect of the present invention is the unique ultrasonic transmitter 11, which is compact, inexpensive, and which has a self-contained, non-depleting power source. As shown in FIG. 8, the transmitter includes an outer cover 21 which defines the generally rectangular solid form of the transmitter. Extending from the front face 22 of the transmitter is a knob 23 which is rotatable through an angle of 180° from an off position 24 to an armed position 26.

Figure 5:
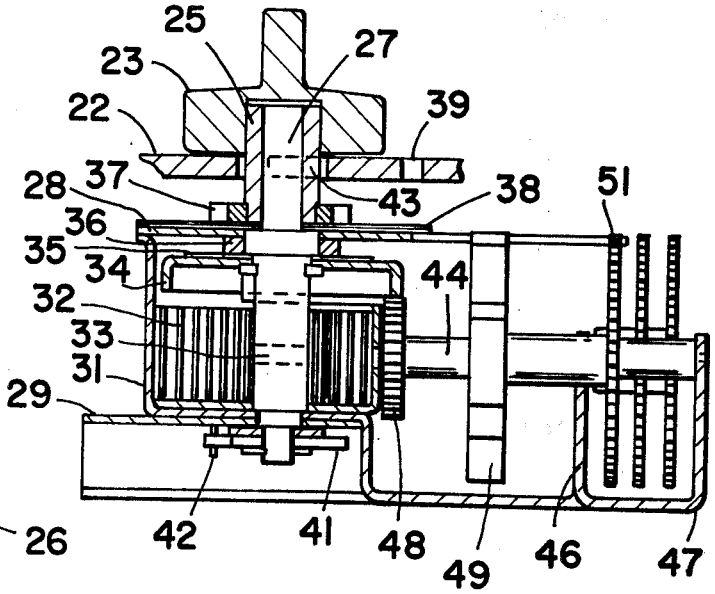
FIG. 5 is a cross-sectional bottom view of the motor mechanism of the ultrasonic transmitter of the present invention.

With reference to FIG. 5, the knob 23 is secured to the upper end of a motor shaft 27, on a sleeve 25 thereabout. A pin 43 extends from the shaft into a 180° slot in the sleeve. The shaft 27 is journalled between an upper plate 28 and a base plate 29, both of the plates serving to support the elements of the mechanisms of the transmitter. Disposed concentrically about the motor shaft is a motor housing 31, in which resides a spiral wound motor spring 32. The spring is secured to the shaft by a motor catch pin 33 extending through the shaft and the inner portion of the spring. Joined to the lower end of the shaft 27 below the base plate is a 180° limit key 41 which engages a pin 42 depending from the base plate. An annular notch in the periphery of the limit key permits only 180° of shaft rotation before being stopped by the pin 42.

Secured to the shaft 27 above the motor spring is a crown gear 34. Directly above and adjacent to the crown gear is a spider ratchet 35, which is disposed adjacent to a spacer spider 36. As is known in the art, the spacer spider and the spider ratchet coact to permit unloading of the motor spring only by rotation of the crown gear. Disposed above the upper plate 28 and secured to the shaft 27 is a disc 38 bearing color indicia on various portions thereof. These colored indicia may be viewed through the hole 39 in the cover 22 to apprise the viewer of the armed or disarmed state of the transmitter. Directly adjacent to the disc 38 and secured to the sleeve 25 is a pinion gear 37.

Disposed perpendicularly to the motor shaft 27 is a sprocket shaft 44, which is supported at one end by a journal in the motor spring housing, and by the latter of a pair of plates 46 and 47 extending from the base plate. Secured to the shaft 44 at one end thereof is a pinion gear 48 which meshes with the crown gear 34 in a driven relationship. Also secured to the shaft 44 at a medial portion thereof is a sprocket wheel 49 which drives the ultrasonic sounding mechanism, as will be explained in the following. A pinion gear 51 is also secured to the shaft 44.

Supported between the plates 46 and 47 are a pair of meshing pinion gear assemblies 52 and 53, as shown in FIG. 2. The assembly 52 is driven by the pinion gear 51 on sprocket shaft 44, and the pinion assembly 53 in turn drives a pinion gear 54 on the extreme end of a governor shaft 56. It may be appreciated from the detail of FIG. 2 that the drive train comprising gear 51, pinion gear assemblies 52 and 53, and the gear 54 significantly increase the rotational speed of the driving crown gear 34.

One end of the governor shaft is supported by the plate 47, and the other end is secured in a generally cylindrical governor member 57 disposed coaxially thereabout. Secured to a medial portion of the governor shaft is a governor hub 58, to which a U-shaped leaf spring 59 is secured by an adjustment spring 61. The distal ends of the leaf spring extend into the cavity defined by the governor member 57, and a friction tip 62 is secured to each end of the spring. The position of the spring 61 is adjustable in the axial direction to select the desired free length of the leaf spring.

As the shaft 56 is driven in rapid rotation by the drive train described in the foregoing, the centrifugal force on the tips 62 will cause them to overcome the resilience of the spring and frictionally engage the inner surface of the member 57. The rotation of the shaft 56 is thus slowed just until the centrifugal force is insufficient to cause the tips to engage the member 57. In this manner the speed of the governor shaft may be maintained within a 2% tolerance. The spring 61 is employed to select the appropriate free length of the leaf spring which yields the desired rotational speed. Due to the fact that the governor shaft is linked to the sprocket shaft by the drive train, the sprocket shaft is thus also constrained to rotate at a uniform, predetermined speed.

Figure 6:
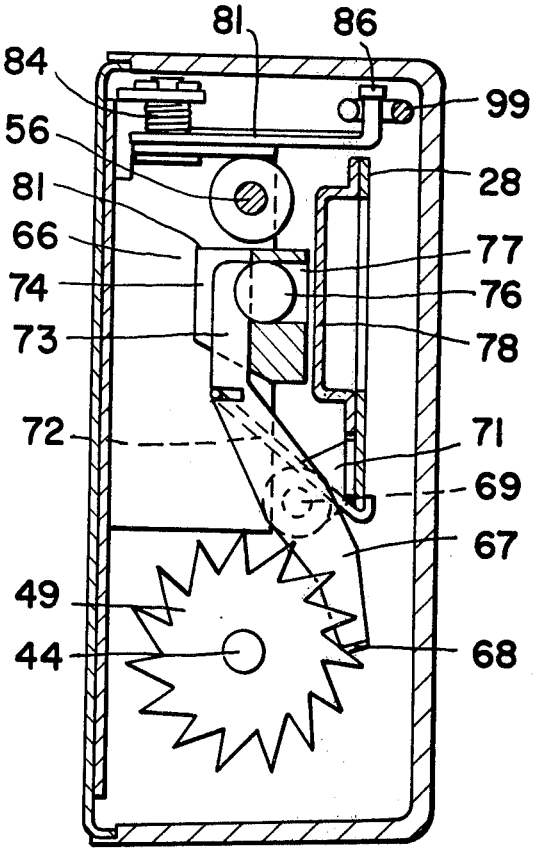
FIG. 6 is a cross-sectional side view of the sounding mechanism of the ultrasonic transmitter of the present invention.

The sprocket wheel 49 serves to drive the ultrasonic generating mechanism 66, shown in detail in FIG. 6. The mechanism 66 includes a lever 67 having a detent 68 which engages the teeth of the sprocket wheel 49. The lever 67 is pivotally secured to a pivot 69 which extends from a bracket 71 joined to the top plate 28. A helical spring is also secured about the pivot 69, one end of the spring being secured to the lever to bias the lever in the clockwise direction, as viewed in FIG. 6.

The other end of the lever is hardened to form a striker, and is received freely in a slot 74 in a ball housing 81. A cylindrical passage 77 extends through the housing from the slot, and a steel ball 76 is freely disposed in the passage. Directly adjacent to the housing and almost coaxial with the passage 77 is a metal sounding diaphragm 78, which is of a size and mass to resonate at an ultrasonic frequency. In the preferred embodiment the resonant frequency is approximately 25 KHz. The ball 76 is maintained in a retracted position in the passage 77 by a pair of permanent magnets 79 secured to the housing 81 and spaced about the passage, (see FIG. 3).

It may be appreciated that as the sprocket wheel 49 is rotated by the crown gear, the oblique leading surface of each tooth provides a camming action against the detent 68. This camming action drives the lever in counterclockwise rotation against the bias of the spring 72, lifting the end 73 of the lever partially out of the slot 74. As the detent 68 falls off a tooth, the stored spring energy is transformed into the kinetic energy of the lever and spring. The hardened end 73 strikes the ball 76 in a highly elastic collision, driving the ball into the diaphragm. The ball and diaphragm are approximately equal in mass to effect maximum energy transfer to the diaphragm. The ball rebounds from the diaphragm before the diaphragm begins to vibrate, so that no multiple impact can occur. The ball returns into the passage 77 as the diaphragm oscillates, but the passage, which is inclined slightly from the axis of the diaphragm, causes the ball to roll into the passage and dissipate its remaining kinetic energy. The ball is latched by the magnets 79 in the inner portion of the passage, ready for the next impact with the lever. With the sprocket wheel turning at a constant speed determined by the governor, the lever is driven to strike the ball in uniform periodic motion and generate a train of ultrasonic bursts. It should be noted that a sprocket wheel having non-uniformly spaced teeth could be provided, to produce a pulse code modulated ultrasonic signal.

The rotation of the governor shaft, and ultimately the actuation of the sounding mechanism 66, is controlled by a striker 81 secured to a pivot 83 adjacent to the gear 54, as shown in FIGS. 2 and 3. The striker includes a triangular portion 82 which extends from the housing of the transmitter, and a T-shaped dog 86 which extends normally from the planar striker at the end thereof opposite the pivot 83. Adjacent to the dog 86 is a detent 87. A spring 84 secured about the pivot 83 is joined at one end to the striker to bias the striker to extend out of the housing.

Secured about the governor shaft 56 in nonrotating fashion is a helical spring 88, which includes one end thereof extending tangentially therefrom. With the striker 81 rotated clockwise and into the housing, the detent 87 engages the end 89 of the spring 88 and immobilizes the governor shaft. This action also stops the drive train and the sounding mechanism. Force must be applied continuously to the striker to keep it in engagement with the spring end 89 and prevent actuation of the sounding mechanism. Should this force be interrupted, the shaft 56 will be freed and the transmitter will begin to generate ultrasonic pulses. The spring 88 is also able to absorb the shock from the detent of the striker being driven into the housing with great force by a slamming door or window.

The present invention is also provided with an arming and disarming mechanism which controls the overall function of the transmitter. The arming and disarming mechanism includes the knob 23, sleeve 25, and gear 37 mentioned previously, as well as an A/D shaft 91 parallel to motor shaft 27 and shown in FIG. 7. The shaft 91 includes a slotted end 92 which is journalled in a buttress 93 extending from the base plate. The slotted end is adapted to engage the strike of a key operated locking device or the like, so that the operation of the transmitter may be controlled from outside the protected enclosure.

Figure 7:
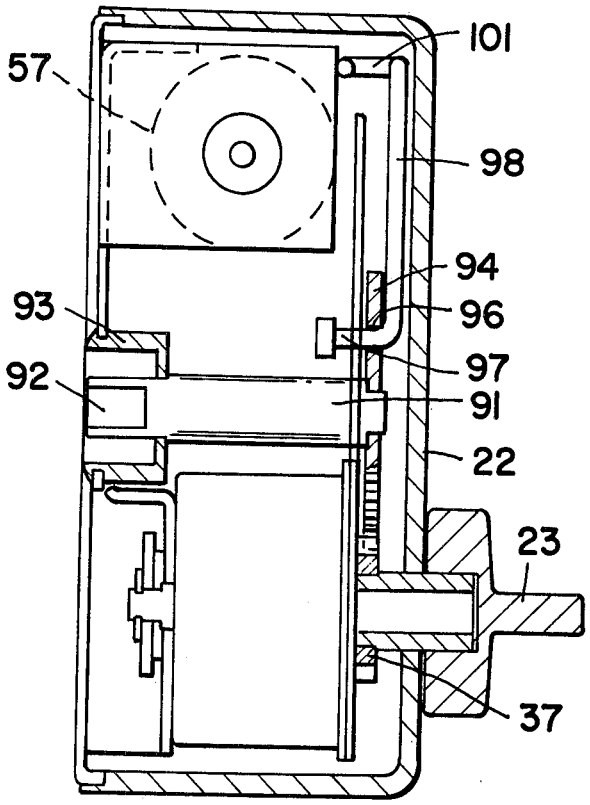
FIG. 7 is a cross-sectional side view of the striker retaining mechanism of the ultrasonic transmitter of the present invention.

Secured to the other end of the shaft 91 is a gear 94 which meshes with the gear 37. As shown in FIG. 7 and FIG. 2, a linking member 98 is disposed generally parallel to and adjacent the front cover of the transmitter. The linking member includes a hook 97 which is received through a hole 96 in the gear 94, the hook extending perpendicularly from the transverse portion 99 of the linking member. The other end of the linking member is formed into a bail 101, the dog 86 of the striker being engaged therein. It may be appreciated that as the gear 94 rotates counterclockwise as viewed in FIG. 2, the linking member will be driven to translate laterally from right to left, as viewed in FIG. 3. The linking member will thus draw the striker into the transmitter, causing the detent 87 to immobilize the drive, governor, and sounding mechanisms.

To maintain the striker in the retracted position against the countervailing force of the spring 84, a detent tab 102 is provided adjacent to the front cover of the transmitter. The detent tab comprises a leaf spring which includes a dimple 103 formed therein which is adapted to engage either hole 104 in the gear 94. The detent thus immobilizes the gear against the spring force and retains the striker in the retracted, disarmed position, or in the released, armed position. It should be noted that rotation of the A/D shaft either directly or by means of the knob 23 will overcome the detent action of the tab 102.

OPERATION OF THE ULTRASONIC TRANSMITTER OF THE PREFERRED EMBODIMENT

To protect an area from intrusion or burglary, a plurality of ultrasonic transmitters 11 are secured to the doors and windows of the area. Each transmitter may be mounted in any orientation on a door or window, or on the jambs thereof, so that closure of the door or window will maintain the striker of each unit 11 within the unit. A trip wire may also be employed advantageously with a unit 11 to detect unauthorized movement within an area, as is well known in the art. A transceiver 12 is also deployed within the protected area to relay any signal to the central monitoring unit.

A unit 11 is normally armed and disarmed, and the spring thereof is wound by means of the knob 23. With the knob in the disarm position 24, it must be rotated 180° counterclockwise to effect arming and winding of the spring 32. Arming is accomplished by the gear 37 on the sleeve 25 meshing with the gear 94 and rotating the gear 94 to translate the linking member 98. The striker is thus released from the unit, and is armed. Concurrently, should the motor spring be in a discharged state, the trailing edge of the slot in the sleeve 25 will engage the pin 43 extending from the motor shaft and rotate the shaft to wind the spring. It may be appreciated that once the spring is wound, further actuation of the knob will not further load the spring, and overwinding is impossible. Also, the key 41 and the pin 42 limit the rotation of the motor shaft to 180°.

The A/D shaft 92 may also be employed to arm or disarm the unit. For example, if the unit is affixed to a door and the user wishes to exit from the door, the knob is first returned to the disarm position. The user then exits, closes the door, and rearms the unit by means of a key locking device which rotates the shaft 92 and releases the striker once more. At the same time the gear 37 rotates the knob to the arm position and winds the spring if it is unloaded.

Any occurrence which permits the striker of any armed unit to extend from that unit will cause it to emit an ultrasonic tone burst. As the striker extends outwardly the governor shaft is freed for rotation, and the remainder of the drive train is thus also free to turn. The sprocket shaft quickly accelerates to the governor determined speed under the urging of the motor spring transferred through the crown gear. The sprocket wheel drives the lever 67 in reciprocating motion, and the lever in turn impacts repeatedly against the ball 76 to drive it into the diaphragm. The pulses of ultrasonic sound are thus generated until the motor shaft rotates through 180° and is stopped by the key 41. The disc 38 also rotates with the motor shaft to present a significant color such as red below the hole 39 in the cover. This color shift permits the user to ascertain easily which unit has sent the tone burst, and to determine where intrusion has been attempted.

I claim:

1. A burglar alarm system, comprising:

a plurality of ultrasonic transmitter units, each of said units including means for detecting unauthorized intrusion or movement and means for transmitting a plurality of pulses that have a fixed code pattern of pulse durations and intervals between pulses, and a fixed ultrasonic frequency for each pulse in response to actuation of said detecting means;

at least one transceiver means for receiving said ultrasonic pulses and generating a radio frequency signal in response only to both said fixed ultrasonic frequency and said fixed pulse pattern; and a central monitoring means for receiving said radio frequency signal and emitting an alarm signal in response thereto.

2. The burglar alarm system of claim 1, wherein said transmitting means in said transmitter units each include spring motor means for driving said transmitting means.

3. The burglar alarm system of claim 2, wherein said spring motor means includes governor means for regulating the drive speed of said spring motor means.

4. The burglar alarm system of claim 2, wherein said spring motor means includes a sprocket wheel rotated thereby for driving said transmitting means uniformly and periodically.

5. The burglar alarm system of claim 1, wherein said transmitting means includes a diaphragm and means for striking said diaphragm periodically and uniformly.

6. The burglar alarm system of claim 5, wherein said striking means includes a ball disposed in a housing adjacent to said diaphragm.

7. The burglar alarm system of claim 6, wherein said striking means includes a lever for driving said ball into said diaphragm.

8. The burglar alarm system of claim 7, further including a sprocket wheel operatively associated with said lever for driving said lever reciprocally to strike said ball repeatedly.

9. The burglar alarm system of claim 8, further including motor means for driving said sprocket wheel in uniform rotational motion.

10. The burglar alarm system of claim 9, wherein said motor means includes a spring motor and a governor for regulating said spring motor to a constant speed.

11. The burglar alarm system of claim 1, further including a striker for sensing intrusion or unauthorized movement, said striker including a detent for halting said transmitting means.

12. The burglar alarm system of claim 11, including resilient means for biasing said striker to extend out of said transmitter unit and releasing said detent from said transmitter means.

13. The burglar alarm system of claim 12, further including arm/disarm means for selectively and releasably holding said striker within said transmitter unit with said detent in engagement with said transmitter means.

14. In a purely mechanical burglar alarm system, a device for signalling unauthorized intrusion or movement, comprising mechanical ultrasonic transmitter means for emitting a burst of ultrasonic pulses that have a fixed code pattern of pulse durations and intervals between pulses, and a fixed ultrasonic frequency for each pulse when driven, mechanical motor means for driving said transmitter means when actuated, mechanical means for arming and disarming said device, and mechanical striker means for sensing unauthorized movement or intrusion to actuate said motor means.

15. The device of claim 14, further including governor means for regulating said motor to a predetermined speed.

16. The device of claim 14, wherein said motor means comprises a spring motor.

17. The device of claim 14, further including a sprocket wheel driven by said motor means for driving said transmitter.

18. The device of claim 17, including a lever driven by said sprocket wheel in reciprocating motion, said lever driving said transmitter.

19. The device of claim 18, wherein said transmitter includes a diaphragm having an ultrasonic resonant frequency, and a ball for striking said diaphragm, said ball being struck by said reciprocally driven lever.

20. The device of claim 14, wherein said striker includes a detent for halting said motor means.

21. The device of claim 20, wherein said striker is spring biased to extend from said device and to release said detent from said motor means.

22. The device of claim 21, wherein said arm/disarm means includes a bail secured to a portion of said striker, said bail adapted to secure said striker within said device with said detent in engagement with said motor means.

23. The device of claim 22, wherein said bail extends eccentrically from a gear secured to an arm/disarm shaft.

* * * * *